US007531083B2

(12) United States Patent
Holmes et al.

(10) Patent No.: US 7,531,083 B2
(45) Date of Patent: May 12, 2009

(54) CYCLOALKANE BASE OILS, CYCLOALKANE-BASE DIELECTRIC LIQUIDS MADE USING CYCLOALKANE BASE OILS, AND METHODS OF MAKING SAME

(75) Inventors: Steven Allen Holmes, Houston, TX (US); John Robert Powers, Kingwood, TX (US); Michael Phillip Smith, The Woodlands, TX (US); Abraham Robert Dekraker, Sugar Land, TX (US)

(73) Assignee: Shell Oil Company, Houston, TX (US)

( * ) Notice: Subject to any disclaimer, the term of this patent is extended or adjusted under 35 U.S.C. 154(b) by 797 days.

(21) Appl. No.: 11/153,812

(22) Filed: Jun. 15, 2005

(65) Prior Publication Data

US 2006/0100467 A1 May 11, 2006

Related U.S. Application Data

(63) Continuation-in-part of application No. 10/983,839, filed on Nov. 8, 2004.

(51) Int. Cl.
*C10G 57/00* (2006.01)
*C10M 105/04* (2006.01)

(52) U.S. Cl. ..... 208/70; 208/18; 208/19; 208/67; 508/563; 508/584; 585/16; 585/20

(58) Field of Classification Search ..... 208/67, 208/70, 18, 19
See application file for complete search history.

(56) References Cited

U.S. PATENT DOCUMENTS

| | | | | |
|---|---|---|---|---|
| 3,419,497 | A | 12/1968 | Rocchini et al. | |
| 3,640,868 | A | 2/1972 | Rocchini et al. | |
| 3,714,021 | A | 1/1973 | Takahashi et al. | |
| 3,764,518 | A | 10/1973 | Henke et al. | |
| 3,959,162 | A | 5/1976 | Nishimatsu et al. | |
| 4,228,024 | A | 10/1980 | Schulz et al. | |
| 4,500,417 | A | 2/1985 | Chen et al. | |
| 4,906,350 | A | 3/1990 | Lucien et al. | |
| 4,943,672 | A | 7/1990 | Hamner et al. | |
| 5,015,793 | A | 5/1991 | Sato et al. | |
| 5,017,733 | A | 5/1991 | Sato et al. | |
| 5,059,299 | A | 10/1991 | Cody et al. | |
| 5,107,041 | A | 4/1992 | Abe et al. | 585/20 |
| 5,113,029 | A | 5/1992 | Sato et al. | |
| 5,126,065 | A | 6/1992 | Tsubouchi et al. | 252/56 R |
| 5,135,638 | A | 8/1992 | Miller | |
| 5,136,116 | A | 8/1992 | Ohhazama et al. | 585/6.6 |
| 5,282,958 | A | 2/1994 | Santilli et al. | |
| 5,306,860 | A | 4/1994 | Bigeard et al. | |
| 5,332,529 | A | 7/1994 | Mead et al. | |
| 5,362,378 | A | 11/1994 | Borghard et al. | |
| 5,776,517 | A | 7/1998 | Ciccone et al. | |
| 6,048,474 | A | 4/2000 | Storr et al. | |
| 6,090,989 | A | 7/2000 | Trewella et al. | |
| 6,165,949 | A | 12/2000 | Berlowitz et al. | 508/363 |
| 6,391,228 | B1 | 5/2002 | Berger et al. | |
| 6,806,237 | B2 | 10/2004 | O'Rear | 508/110 |
| 6,828,283 | B2 | 12/2004 | Chapaton et al. | 508/110 |
| 7,015,178 | B2 | 3/2006 | Koga et al. | 508/463 |
| 7,045,488 | B2 | 5/2006 | Bartley et al. | 508/110 |
| 7,056,869 | B2 | 6/2006 | Guyomar et al. | 508/110 |
| 7,473,345 | B2 * | 1/2009 | Rosenbaum et al. | 208/18 |
| 2002/0139962 | A1 | 10/2002 | Fefer et al. | |

FOREIGN PATENT DOCUMENTS

| | | | |
|---|---|---|---|
| EP | 0 030 249 | | 6/1981 |
| EP | 0 458 574 | A2 | 11/1991 |
| EP | 0 776 959 | A2 | 6/1997 |
| EP | 1368446 | A0 | 12/2003 |
| GB | 1332509 | | 10/1973 |
| JP | 05166412 | A | 7/1993 |
| JP | 05182525 | A | 7/1993 |
| JP | 10021761 | A | 1/1998 |
| JP | 11185530 | A | 7/1999 |
| WO | WO 97/22572 | A1 | 6/1997 |
| WO | WO 01/18158 | A1 | 3/2001 |
| WO | WO02064710 | A2 | 8/2002 |

OTHER PUBLICATIONS

U.S. Appl. No. 60/548,002, filed Feb. 26, 2004.
ASTM D3487, "Standard Specification for Mineral Insulating Oil Used in Electrical Apparatus", pp. 1-5, May 22, 1988.
Product description for MACRON® EDM Oil 135, Soc: 02374-12/02.
Product description for Shell Diala® A & AX, Soc: 39-12/02.

* cited by examiner

*Primary Examiner*—Ellen M McAvoy

(57) ABSTRACT

Cycloalkane base oil, methods of making cycloalkane base oil, and dielectric liquid comprising cycloalkane base oil, the cycloalkane base oil comprising a quantity of isoparaffins and from 50 wt. % to 70 wt. % cycloalkanes having the formula $C_nH_{2n}$ wherein n is from 15 to 30, said quantity of isoparaffins being less than 50 wt. % of said cycloalkane base oil.

55 Claims, No Drawings

CYCLOALKANE BASE OILS, CYCLOALKANE-BASE DIELECTRIC LIQUIDS MADE USING CYCLOALKANE BASE OILS, AND METHODS OF MAKING SAME

PRIORITY DATA

The present application is a continuation-in-part of U.S. patent application Ser. No. 10/983,839, filed Nov. 8, 2004 (pending).

FIELD OF THE APPLICATION

The application relates to "cycloalkane" base oil(s), to cycloalkane-base dielectric liquid(s) made using the cycloalkane base oil(s), to methods of making the cycloalkane base oil(s) and to the cycoalkane-base dielectric liquid(s).

BACKGROUND

Dielectric liquids typically are manufactured from a gas oil fraction derived at atmospheric pressure from naphthenic crudes. Dielectric liquids manufactured using other feedstocks are desirable.

BRIEF SUMMARY

The present application provides cycloalkane base oil comprising a quantity of isoparaffins and from 50 wt. % to 70 wt. % cycloalkanes having the formula $C_nH_{2n}$ wherein n is from 15 to 30, said quantity of isoparaffins being less than 50 wt. % of said cycloalkane base oil (as measured by mass spectroscopy).

The application also provides a cycloalkane-base dielectric liquid comprising:

cycloalkane base oil comprising a quantity of isoparaffins and from 50 wt. % to 70 wt. % cycloalkanes having the formula $C_nH_{2n}$ wherein n is from 15 to 30, said quantity of isoparaffins being less than 50 wt. % of said cycloalkane base oil (as measured by mass spectroscopy); and, one or more antigassing agent selected from the group consisting of non-phenolic alkyl substituted or partially saturated aromatic compounds comprising at least one labile hydrogen atom and diaryls, said quantity being effective to reduce the gassing tendency of the dielectric liquid.

The application provides a method for making a cycloalkane base oil comprising:

refining crude under refining conditions effective to produce aromatic vacuum gas oil boiling at a temperature in the range of from about 371° C. to about 538° C., the aromatic vacuum gas oil comprising carbonaceous materials, a majority of the carbonaceous materials being selected from the group consisting of cycloalkanes and aromatics;

contacting the aromatic vacuum gas oil with hydrocracking catalyst under hydrocracking conditions effective to produce hydrocracking product;

subjecting hydrocracking product to stripping conditions effective to increase the content of cyclic hydrocarbons selected from the group consisting of cycloalkanes, cycloalkenes, and combinations thereof and removing hydrogen sulfide and ammonia and producing stripped hydrocracking product;

contacting stripped hydrocracking product with isomerization/dewaxing/hydrogenation (IDH) catalyst comprising a metal selected from the group consisting of platinum, palladium, and combinations thereof, under IDH conditions effective to saturate aromatics to cycloalkanes, reduce normal paraffins, and to produce IDH product comprising greater than 50 wt. % of one or more cyclic hydrocarbons selected from the group consisting of cycloalkanes and cycloalkenes;

without solvent extracting, contacting IDH product with hydrotreating catalyst under hydrotreating conditions effective to produce hydrotreated product comprising greater than 50 wt. % cycloalkanes (as measured by mass spectroscopy); and, separating from said hydrotreated product cycloalkane base oil comprising less than 50 wt. % isoparaffins and 50 wt. % or more cycloalkanes (as measured by mass spectroscopy), said cycloalkane base oil boiling at a temperature in the range of from about 260° C. to about 371° C.

A method for making a cycloalkane base dielectric liquid comprising:

processing aromatic vacuum gas oil and recovering cycloalkane base oil comprising a quantity of isoparaffins and from 50 wt. % to 70 wt. % cycloalkanes having the formula $C_nH_2$ wherein n is from 15 to 30, said quantity of isoparaffins being less than 50 wt. % of said cycloalkane base oil (as measured by mass spectroscopy); and, adding to said cycloalkane base oil one or more agent selected from the group consisting of an amount of antigassing agent effective to reduce gassing tendency of the cycloalkane base oil and a quantity of one or more antioxidant effective to reduce sludge formation and total acid number in mg of KOH/g (TAN) under oxidation conditions.

DETAILED DESCRIPTION

The present application provides cycloalkane base oil(s) for producing cycloalkane-base dielectric liquid(s).

A "cycloalkane base oil" is produced from an aromatic base oil feedstock, preferably an "aromatic vacuum gas oil" produced from the refining of crude oil. Substantially any crude oil may be used as the source of the aromatic vacuum gas oil. Suitable crudes include, but are not necessarily limited to: Arabian Light, Arabian Medium, Arab Heavy, Orienta, Kuwati, Isthmus, Maya, Oman, Brent, and combinations thereof.

A majority of the carbonaceous materials in suitable "aromatic vacuum gas oils" are selected from the group consisting of cycloalkanes and aromatics. Aromatic vacuum gas oil generally comprises the following distribution of carbonaceous materials, in descending order of concentration: aromatics >cycloalkanes >isoparaffins >normal paraffins.

Suitable aromatic vacuum gas oils boil at a temperature in the range of from about 260° C. (500° F.) to about 538° C. (1000° F.), preferably from about 371° C. (700° F.) to about 538° C. (1000° F.). The aromatic content of suitable aromatic vacuum gas oils is from about 40 wt. % to about 60 wt. % (as measured by mass spectroscopy). In preferred embodiments, the aromatic content of the aromatic vacuum gas oils is from about 50 to about 60 wt. %, more preferably from about 55 wt. % to about 60 wt. % (as measured by mass spectroscopy). Aromatic vacuum gas oils also typically comprise from about 20 wt. % to about 30 wt. % cycloalkanes, from about 10 wt. % to about 15 wt. % isoparaffins, from about 5 wt. % to about 15 wt. % normal paraffins (as measured by mass spectroscopy).

The aromatic vacuum gas oils also may be mixed with other base oil feedstocks, including, but not necessarily limited to solvent extracted raffinates, soft wax, slack wax, lube boiling range product from a Fischer-Tropsch conversion of gas-to-liquids, and combinations thereof.

In order to produce cycloalkane base oil, aromatic vacuum gas oil is subjected to hydroprocessing conditions. In a preferred embodiment, the hydroprocessing conditions comprise: contacting the aromatic vacuum gas oil with hydrocracking catalyst under hydrocracking conditions effective to produce hydrocracking product; subjecting the hydrocracking product to stripping conditions effective to remove hydrogen sulfide and any ammonia and to produce stripped hydrocracking product; contacting the stripped hydrocracking product with isomerization/dewaxing/hydrogenation ("IDH") catalyst under conditions effective to saturate aromatics to produce cycloalkanes and to reduce normal paraffins to produce an IDH product comprising carbonaceous molecules, a majority of the carbonaceous molecules comprising one or more cyclic hydrocarbons selected from the group consisting of cycloalkanes and cycloalkenes; contacting IDH product with hydrotreating catalyst under hydrotreating conditions effective to produce hydrotreated product comprising greater than 50 wt. % cycloalkanes (as measured by mass spectroscopy); and subjecting the hydrotreated product to separation conditions effective to separate a cycloalkane base oil comprising a fraction boiling at a temperature of from about 260° C. to about 371° C.

The cycloalkane base oil may be analyzed for content by a number of methods, a preferred method being mass spectroscopy. A preferred method of mass spectroscopy uses the AutospecQ, a MICROMASS® high resolution magnetic sector mass spectrometer, commercially available from Waters Corporation, Milford, Mass. In this embodiment, the ionization mode is Field Ionization Mass Spectrometry (FIMS), which produces primarily molecular ions with little or no fragmentation for the various hydrocarbon types associated with the oils. FIMS data is processed using Poly32, a PC based software package which processes mass spectral list files in order to generate size exclusion chromatography (SEC) type data and other computations. Poly 32 is commercially available from Sierra Analytics, Modesto, Calif. The SEC data includes molecular weight moments and polydispersity calculations. They are calculated from M, mass in Daltons, and n, number of moles over the mass range of interest. The software also will calculate percentages of oligomer series defined by mass and repeating or monomer units such as $CH_2$ groups. In the case of hydrocarbon analysis, a table is generated with percentages of each carbon number and each Z series (where Z is defined by the generalized formula for hydrocarbons $C_nH_{2n+Z}$). Z series descriptors for saturates are based on the assumption that the oils contain insignificant amounts of aromatics. Therefore, trace aromatics and contaminants are removed by column chromatography (ASTM D 2549) prior to analysis by FIMS.

Hydrocracking Conditions

In order to produce the cycloalkane base oil, the aromatic vacuum gas oil is subjected to hydrocracking conditions generally comprising hydrocracking catalyst. Substantially any hydrocracking catalyst effective to increase the rate of desired hydrocracking is suitable. The hydrocracking catalyst generally comprises a suitable hydrocracking metal on a carrier.

Suitable hydrocracking metals include, but are not necessarily limited to sulfided catalysts comprising one or more metals selected from the group consisting of cobalt, chromium, molybdenum, tungsten, magnesium, rhenium, iron, ruthenium, iridium, nickel, palladium, platinum, and combinations thereof. In one embodiment, the hydrocracking metal is one or more metal selected from the group consisting of Ni/W, Ni/Mo, and Co/Mo. In a more preferred embodiment, the hydrocracking metal is one or more metal selected from the group consisting of Ni/W and Co/Mo.

The hydrocracking catalyst comprises substantially any carrier which provides sufficient surface area and does not interfere with hydrocracking. Examples of suitable carriers include, but are not necessarily limited to metal oxides and molecular sieves. In one embodiment, the carrier is selected from the group consisting of alumina and crystalline alumino silicates.

Suitable hydrocracking conditions comprise: hydrocracking temperatures of from about 200° C. and about 450° C.; hydrocracking hydrogen gas pressures of greater than atmospheric, preferably about 30 atmospheres or more; hydrocracking hydrogen circulation rates of from about 400 SCF/B (standard cubic feet per barrel) to about 15,000 SCF/B; and hydrocracking liquid hourly space velocities of from about 0.1 $hr^{-1}$ to about 20 $hr^{-1}$. Generally, the hydrocracking conditions are effective to convert polynuclear aromatics in the heavy aromatic gas oil into smaller partially hydrogenated aromatic and hydrogenated species, to convert some normal paraffins to isoparaffins and to convert sulfur and nitrogen present in the heavy aromatic gas oil to hydrogen sulfide and ammonia.

Stripping Conditions

The hydrocracking product is subjected to stripping conditions effective to remove hydrogen sulfide and ammonia and to produce a stripped hydrocracking product. Suitable stripping conditions comprise a temperature of from about 200° C. to about 300° C. and an effective stripping pressure, preferably greater than atmospheric pressure. In a more preferred embodiment, the stripping pressure is substantially the same as the hydrocracking pressure, most preferably about 30 atm or greater. Preferably, stripping gas is hydrogen essentially free of hydrogen sulfide and ammonia.

Isomerization/Dewaxing/Hydrogenation (IDH) Conditions

The stripped hydrocracking product is subjected to hydroprocessing conditions, preferably isomerization/dewaxing/hydrogenation ("IDH") conditions, effective to increase the content of hydrogenated and partially hydrogenated cyclic hydrocarbons selected from the group consisting of cycloalkanes, cycloalkenes, and combinations thereof. The hydroprocessing conditions, preferably IDH conditions, also typically increase the content of isoparaffins by isomerizing normal and near normal paraffins to isoparaffins. In a preferred embodiment, the hydroprocessing conditions are effective to produce about 20 wt. % or more isoparaffins, more preferably from about 20 wt. % to less than 50 wt. % isoparaffins, most preferably from about 20 wt. % to about 40 wt. % isoparaffins (as measured by mass spectroscopy).

The IDH conditions generally comprise contacting the stripped hydrocracking product with one or more IDH catalyst at an IDH temperature, an IDH pressure, and an IDH hydrogen flowrate effective to increase the content of cyclic hydrocarbons selected from the group consisting of cycloalkanes, cycloalkenes, and combinations thereof. The IDH conditions also generally are effective to increase the content of isoparaffins.

Suitable IDH catalysts comprise one or more IDH metal, including but not necessarily limited to cobalt, chromium, molybdenum, tungsten, magnesium, rhenium, iron, ruthenium, iridium, nickel, palladium, platinum, and combinations thereof. Preferred IDH metal(s) include, but are not necessarily limited to platinum, palladium, and combinations thereof.

The IDH metal generally is disposed on a suitable IDH metal carrier. Suitable IDH metal carriers include, but are not necessarily limited to molecular sieves and metal oxides. Suitable molecular sieves include, but are not necessarily limited to zeolites and silicoaluminophosphate molecular sieves. Suitable metal oxides include, but are not necessarily limited to alumina. A preferred IDH metal carrier comprises silicoaluminophosphate molecular sieves.

Suitable zeolites are intermediate pore size zeolites. Preferred intermediate pore size zeolites have a pore diameter of from about 0.35 to about 0.8 nm. Specific examples of suitable zeolites include, but are not necessarily limited to zeolite Y, zeolite beta, zeolite theta, mordenite, ZSM-3, ZSM-4, ZSM-5, ZSM-11, ZSM-12, ZSM-18, ZSM-20, ZSM-22, ZSM-23, ZSM-35, ZSM-38, ZSM-48, SSZ-32, offretite, ferrierite, zeolite alpha, and mixtures thereof. Because of their isomerization selectivities, preferred zeolites include, but are not necessarily limited to ZSM-12, ZSM-23, ZSM-22, SSZ-32, and combinations thereof.

Suitable silicoaluminophosphate molecular sieves include, but are not necessarily limited to SAPO-11, SAPO-31, SAPO-41, and combinations thereof. A preferred silicoaluminophosphate molecular sieve is SAPO-11. See also the following U.S. patents, which are hereby incorporated by reference: U.S. Pat. Nos. 6,090,989; 4,500,417; 4,906,350; 4,943,672; 5,059,299; 5,135,63; 5,282,958, 5,306,860, 5,362,378; and European Patent No. 0 776 959 A2.

Suitable IDH conditions comprise: IDH temperatures of from about 250° C. to about 390° C.; IDH gas pressures greater than atmospheric, preferably substantially the same as the hydrocracking pressure, which is preferably about 30 atm or more; IDH hydrogen circulation rates of from about 400 to about 15,000 SCF/B; and, IDH liquid hourly space velocities of from about 0.1 $hr.^{-1}$ to about 20 $hr^{-1}$.

Hydrotreating

In a preferred embodiment, the hydroprocessing product is hydrotreated. Hydrotreating comprises contacting the IDH product with hydrotreating catalyst under hydrotreating conditions effective to convert unsaturated bonds and remaining aromatics, in particular multi-ring aromatics, in the IDH product into saturated bonds and cycloalkanes, respectively.

Suitable hydrotreating conditions comprise: hydrotreating temperatures of from about 190° C. to about 340° C.; hydrotreating pressures greater than atmospheric, preferably substantially the same as the hydrocracking and IDH pressure, which preferably is about 30 atm or more; hydrogen circulation rates of from about 400 to about 15,000 SCF/B.

Suitable hydrotreating catalyst comprises hydrotreating metal effective to increase the rate of hydrogenation of unsaturated bonds and aromatics in the IDH product. Suitable hydrotreating metal(s) include but are not necessarily limited to cobalt, chromium, molybdenum, tungsten, magnesium, rhenium, iron, ruthenium, iridium, nickel, palladium, platinum, and combinations thereof. Preferred hydrotreating metals are selected from the group consisting of Ni, Pt, Pd, and combinations thereof.

The hydrotreating metal generally is on a suitable support which has sufficient surface area and does not interfere with the hydrotreating process. Suitable hydrotreating catalyst supports include, but are not necessarily limited to metal oxides and molecular sieves. Preferred hydrotreating catalyst supports comprise dispersed zeolite effective to increase saturation of remaining aromatic molecules.

Recovery of Cycloalkane Base Oil

The resulting hydrotreated product boils at a temperature in the range of from about 38° C. (100° F.) to about 538° C. (1000° F.). The hydrotreated product is subjected to separation conditions effective to separate cycloalkane base oil, preferably cycloalkane base oil boiling at a temperature in the range of from about 260° C. to about 371° C. Any suitable separation conditions may be used as long as they are effective to separate cycloalkane base oil boiling at a temperature in the range of from about 260° C. to about 371° C. from the portion of the hydrotreated product (a) boiling at a temperature greater than 700° F. (371° C.), and (b) boiling at a temperature less than 500° F. (260° C.).

In a preferred embodiment, the hydrotreated product is subjected to fractionation conditions comprising removing hydrotreated product boiling at a temperature of greater than 371° C. (700° F.) as a bottoms, and removing hydrotreated product boiling at a temperature of less than 260° C. (500° F.) as an overhead.

A majority of carbonaceous molecules in the cycloalkane base oil comprise cycloalkanes, preferably alkyl-substituted cycloalkanes. Preferably, the cycloalkane base oil comprises a content of cycloalkanes, preferably alkyl-substituted cycloalkanes, of 50 wt. % or more, more preferably about 60 wt. % or more, even more preferably about 66 wt. % or more, as measured by mass spectroscopy.

Cycloalkanes generally have the formula $C_nH_2$, where n is the total number of carbon atoms. In a preferred embodiment, the base oil comprises cycloalkanes wherein n is from about 15 to about 30.

In a preferred embodiment, a majority of the cycloalkanes comprise alkyl-substituted cycloalkanes. Preferably, about 70 wt. % or more, more preferably about 80 wt. % or more, even more preferably about 90 wt. % or more, and most preferably about 99 wt. % or more of the cycloalkanes comprise alkyl-substituted cycloalkanes, as measured by mass spectroscopy.

The cycloalkane base oil comprises less than 50 wt. % isoparaffins, preferably from about 20 wt. % to less than 50 wt. % isoparaffins, more preferably from about 20 wt. % to about 40 wt. % isoparaffins, as measured by mass spectroscopy. The cycloalkane base oil also preferably comprises about 15 ppm sulfur or less, according to Test Method D1274 (incorporated herein by reference).

Production of Cycloalkane-Base Dielectric Liquid(s)

The cycloalkane base oil of the present application has a variety of uses, including but not necessarily limited to use as a base oil in cycloalkane-base dielectric liquids. In a preferred embodiment, the cycloalkane base oil is used to produce cycloalkane-base dielectric liquids meeting the requirements of ASTM D 3487 ("Standard Specification for Mineral Insulating Oil Used in Electrical Apparatus," incorporated herein by reference). Most preferably the cycloalkane base oil is used to produce dielectric liquids suitable for use as transformer oil.

Many types of conventional electrical equipment contain a dielectric fluid for dissipating the heat generated by energized components, and for insulating those components from the equipment enclosure and from other internal parts and devices. Examples of such equipment include, but are not necessarily limited to transformers, capacitors, switches, regulators, circuit breakers, cables, reclosers, and x-ray equipment.

A transformer transfers electric power from one circuit to another electromagnetically. Transformers are used in the transmission of electrical power.

Larger transformers generally require insulation of coils and/or conductors in order to protect the transformer at normal operating voltages, during temperature overvoltages, and also during transient overvoltages, which may result from lightning strikes or switching operations. When insulation fails, an internal fault or short circuit may occur. Such occurrences could cause the equipment to fail, typically leading to system outages and possibly endangering persons in the vicinity of the equipment.

In order to effectively transfer heat away from a transformer core and coil assembly and to maintain an acceptable operating temperature, conventional transformers use relatively large volumes of dielectric fluid as insulation.

In the past, dielectric liquids made from paraffinic oils tended to have inherently poor low temperature viscometric properties and generally did not exhibit low gassing performance, as required by ASTM D 3487.

The gassing tendency of the cycloalkane-base dielectric liquid is a measure of the rate of absorption or desorption of hydrogen into or out of the dielectric liquid under prescribed laboratory conditions. Low gassing performance is important because, if hydrogen is evolved due to electrical stress, a liquid having low gassing tendency tends to absorb the evolved hydrogen and thereby reduce the chances of an explosion.

The cycloalkane-base dielectric liquids of the present application exhibit both low temperature viscometric properties and low gassing tendency.

Gassing tendency is reduced by adding one or more anti-gassing agent(s). Preferably, the anti-gassing agent(s) reduce the gassing tendency of the dielectric liquid to +30 μL/min. or less, preferably 15 μL/min. or less, more preferably 5 μL/min. or less, preferably 0 μL/min. or less, according to ASTM Test Method D2300.

The antigassing agent(s) generally are antigassing aromatic(s) other than phenolic compounds either comprising one or more labile hydrogen atom or comprising diaryls, which may or may not comprise one or more labile hydrogen atoms. Examples of suitable antigassing agents include, but are not necessarily limited to diaryls and agents having from 9 to 11 carbon atoms selected from the group consisting of alkyl-substituted aromatic compounds, alkyl substituted, partially saturated aromatic compounds, and combinations thereof.

Suitable diaryls have the following general structure:

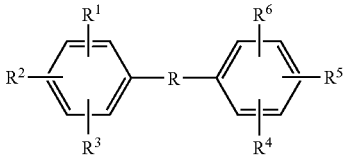

wherein

R is selected from the group consisting of a single continuous bond (making the diaryl a biphenyl) and alkylene groups having from about 1 to 4 carbon atoms (making the diaryl a diaryl alkane); and $R^1$-$R^6$ independently are selected from the group consisting of nothing and alkyl groups having from about 1 to about 2 carbon atoms.

Where R represents a single bond (R=0), the diaryl is a biphenyl having the following general structure:

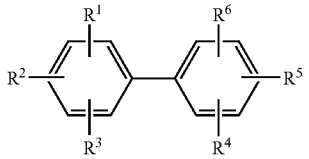

wherein $R^1$-$R^6$ independently are selected from the group consisting of nothing and alkyl groups having from about 1 to about 2 carbon atoms. In a preferred embodiment, $R^1$-$R^6$ are selected from the group consisting of methyl groups. In another preferred embodiment, the biphenyl is unsubstituted, wherein $R^1$-$R^6$ are nothing. In another embodiment, the biphenyl is dimesityl, wherein $R^1$-$R^6$ are methyl groups.

Examples of suitable anti-gassing agents include, but are not necessarily limited to diaryls, dihydrophenanthrene, phenyl ortho xylyl ethane, alkylated benzenes, including diethylbenzenes, tetrahydro-5-(1-phenylethyl)-naphthalene, acenaphthene, tetrahydro-naphthalene, alkylated tetrahydronaphthalenes, and tetrahydroquinoline.

Generally, the one or more anti-gassing agent(s) are added to the cycloalkane-base oil in an amount of about 5 wt. % or less, more preferably about 2 wt. % or less, even more preferably from about 0.5 wt. % to about 1 wt. %, most preferably about 1 wt. %, based on the volume of the base oil.

In one embodiment, the antigassing agent comprises about 80 wt. % 1,5-dimethyl naphthalene and about 20 wt. % isomeric dimethyl naphthalenes.

In another embodiment, the base oil comprises 2 wt. % or less, preferably 1 wt. % or less, more preferably preferably less than 1 wt. % of antigassing agent(s) selected from the group consisting of alkyl substituted or unsubstituted biphenyl and alkyl substituted or unsubstituted diaryl alkanes. Preferred antigassing agent(s) are selected from the group consisting of biphenyl (unsubstitued) and dimesityl.

In a preferred embodiment, antioxidant (described above) also is added the cycloalkane base oil to improve oxidation stability of the cycloalkane-base dielectric liquid, thereby minimizing the development of oil sludge and acidity during storage, processing, and service. Minimizing oxidation minimizes electrical conduction and metal corrosion, maximizes system life, maximizes electrical breakdown strength, and ensures satisfactory heat transfer.

Preferably, when subjected to the acid sludge test (ASTM D2440), the cycloalkane-base dielectric liquid produces a % sludge by mass at 72 hours of 0.15 or less and a 72 hour "total acid number" or "TAN" of 0.5 or less (mg of KOH/g). The cycloalkane-base dielectric liquid also preferably produces a % sludge by mass at 164 hours of 0.5 or less and a TAN of 0.6 or less.

Generally, antioxidant is added in order to minimize sludge and TAN. In a preferred embodiment, the dielectric liquid comprises from about 0.01 wt. % to about 1.0 wt. % antioxidant, preferably from about 0.07 wt. % to about 0.30 wt. % antioxidant based on the weight of the dielectric liquid.

Substantially any antioxidant accepted for use in the particular type of dielectric fluid is suitable. Preferred antioxidants for use in electrical oils are hindered phenols, cinnamate type phenolic esters, and alkylated diphenylamines. More preferred antioxidants, particularly for use in transformer oils, are selected from the group consisting of 2,6-ditertiary-butyl para-cresol, 2,6-ditertiary butylphenol, and combinations thereof. A most preferred antioxidant is a combination of 2,6-ditertiary-butyl para-cresol and 2,6-ditertiary butylphenol.

If desired, a quantity of one or more pour point depressants may be added to the cycloalkane base oil to depress the pour point of the product to about −30° C. or less, preferably to about −40° C. or less. A variety of pour point depressants may be used. Suitable pour depressants include, but are not necessarily limited to pour point depressants based on polymethacrylate chemicals. If pour point depressant(s) are added, the quantity of pour point depressant typically is from about 0.01 wt % to about 0.2 wt % based on the weight of the cycloalkane base oil.

The cycloalkane-base dielectric liquids meet specifications required for a variety of applications, including but not necessarily limited to electrical oils. A preferred use for the cycloalkane-base dielectric liquids is transformer oil(s).

In addition to oxidation resistance and low gassing tendency, the cycloalkane-base dielectric liquids preferably have a number of other properties, including but not necessarily limited to electrical resistance and thermal stability. In a most preferred embodiment, the cycloalkane-base dielectric liquids meet relevant specifications for physical, electrical, and chemical properties for electrical oils provided by ASTM D 3487. In a preferred embodiment, the cycloalkane-base dielectric liquid also meets other relevant standards, incorporated herein by reference, including, but not necessarily limited to: National Electrical Manufacturers Association (NEMA) TR-P8-1975; U.S. Government Military Specification VV-I-530A and Amendment 2 for Class I and Class II fluids (Type I and Type II, respectively)—supersedes the Department of the Navy specification OS-1023; NATO symbol S-756, British Standard BS 148.

The ASTM physical property requirements for electrical oils include, but are not necessarily limited to: a color of about 0.5 or less, as measured using Test Method D1500 (incorporated herein by reference); a flash point of about 145° C. or greater, as measured using Test Method D92 (incorporated herein by reference); an interfacial tension of about 40 dynes/cm or more at 25° C., as measured using Test Method D971 (incorporated herein by reference); a pour point of about −40° C. or less, as measured using Test Method D92 (incorporated herein by reference); a relative density of 0.91 or less, according to Test Method D 1298 (incorporated herein by reference); a visual examination of clear and bright, according to Test Method D1524 (incorporated herein by reference); and, a viscosity of about 76 cSt or less at 0° C., about 12.0 cSt or less at 40° C., and from about 3.0 cSt or less at 100° C., as measured by Test Method D445 (incorporated herein by reference).

The cycloalkane-base dielectric liquid also preferably meets the electrical property requirements for electrical oils, including but not necessarily limited to the ASTM requirements of: a dielectric breakdown voltage of 30 kV or more at 60 Hz by disc electrodes, according to Test Method D877 (incorporated herein by reference); a dielectric breakdown voltage of 20 kV or more at 60 Hz and a 1.02 mm (0.040-inch) gap using new oil by D1816 (incorporated herein by reference); a dielectric breakdown voltage impulse of about 145 kV or more at 25° C. using a needle-to-sphere grounded 25.4 mm (1-inch) gap, according to Test Method D3300 (incorporated herein by reference), and, a power factor at 60 Hz of 0.05% or less at 25° C., and of 0.30% or less at 100° C., using Test Method D924 (incorporated herein by reference).

The cycloalkane-base dielectric liquid also preferably meets chemical property requirements for electrical oils, including but not necessarily limited to the ASTM requirements of: an oxidation inhibitor content for Type I oils of 0.08 wt. % or less, and for Type II oils of 0.3 wt. % or less, as measured using Test Method D2668 (incorporated herein by reference), or, where the oxidation inhibitor is 2,6-ditertiary butyl cresol, as measured using Test Method D1473 (incorporated herein by reference); a low content of elemental sulfur and thermally unstable sulfur-bearing compounds to prevent corrosion of certain metals such as copper and silver in contact with the dielectric liquid, according to Test Method D1274 (previously incorporated herein by reference); 35 ppm or less water according to Test Method D1533 (incorporated herein by reference); a neutralization number of 0.03 mg KOH/g or less, using Test Method D974 (incorporated herein by reference); and, a non-detectible polychlorinated biphenyl (PCB) content, or a content of less than 1 ppm, as measured using Test Method D4059 (incorporated herein by reference).

The application will be better understood with reference to the following examples, which are illustrative only:

EXAMPLE 1

A cycloalkane base oil produced as described above was analyzed and determined to have the following properties:

| | |
|---|---|
| API | 31.6 |
| Specific Gravity g/cc | 0.8676 |
| Pour Point, ° C. (° F.) | −42.8(−45) |
| Cloud Point, ° C. (° F.) | −30.5(−22.9) |
| Viscosity @ 40° C. $mm^2/s$ (cSt)* | 9.172 |
| Viscosity @ 100° C. $mm^2/s$ (cSt) | 2.397 |
| Viscosity Index | 68.7 |

*The viscosity measurements were performed using an automatic Cannon CAV4 instrument. Viscometer according to ASTM D 445, incorporated herein by reference.

EXAMPLE 2

A cycloalkane base oil produced as described above was analyzed and determined to have the following properties:

| | |
|---|---|
| API | 32.4 |
| Specific Gravity g/cc | 0.8633 |
| Pour Point, ° C. (° F.) | −47(−52.6) |
| Cloud Point, ° C. (° F.) | −38(−36.4) |
| Cleveland Open Cup (COC) Flash Point, ° C. (° F.) | 157.8(316) |
| Viscosity @ 40° C. $mm^2/s$ (cSt) | 7.471 |
| Viscosity @ 100° C. $mm^2/s$ (cSt) | 2.112 |
| Viscosity Index | 70.7 |
| UV Aromatics | |
| Monoaromatics (wt. %) | 0.97 |
| Diaromatics (wt. %) | 1.06 |
| tri + aromatics (wt. %) | 0.7 |
| Total (wt. %) | 2.73 |

EXAMPLE 3

A cycloalkane base oil produced as described above was analyzed. Simulated distillation by gas chromatography was performed to determine the temperatures (° C.) at which 5 wt. % and 95 wt. % of the base oil vaporized. ASTM D 6352 "Standard Test Method for Boiling Range Distribution of Petroleum Distillates in Boiling Range from 174 to 700 Degrees C. by Gas Chromatography," incorporated herein by reference. The results are given in the following Table, along with the physical properties of the base oil:

| | |
|---|---|
| 5% vaporization temperature, ° C.(° F.) | 267.8(514) |
| 95% vaporization temperature, ° C.(° F.) | 400.6(753) |
| Viscosity @ 40° C. $mm^2/s$ (cSt) | 9.9 |
| Viscosity @ 100° C. $mm^2/s$ (cSt) | 2.5 |
| VI | 53 |
| Density, g/ml@15.6° C. (60° F.) | 0.854 |
| API Gravity | 34.1 |
| Pour Point, ° C. (° F.) | −45(−49) |
| Pensky-Martens Closed Cup (PMCC) Flash, ° C. | 148 |
| UV Aromatics, mmol/100 g | 6 |
| Sulfur, ppm | 1 |
| Nitrogen, ppm | 1 |

EXAMPLE 4

Cycloalkane base oil from Example 3 was mixed with either 0.075 wt. % or 0.28 wt. % butylated hydroxytoluene (BHT), obtained from CRI Fine Chemicals, Inc. Samples were prepared containing no added aromatic oil, containing 2.0 wt. % C9-C11 alkylbenzenes ("AB"), containing 0.5 wt. % C9-C11 alkylbenzenes, containing 0.5 wt. % dimethyl naphthalenes (DMN), containing 1 wt. % added DMN, and containing 2.0 wt. % biphenyl. The resulting mixture was oxidized at a bath temperature of 110° C., in the presence of a copper catalyst coil, by bubbling oxygen through duplicate test specimens for 72 and 164 h, respectively. The cycloalkane base oil was evaluated at the end of each aging period by measuring the amount of sludge and acid formed. The test specimen was diluted with n-heptane and the solution filtered to remove the sludge. The sludge was dried and weighed. The sludge free solution was titrated at room temperature with 0.01 N potassium hydroxide to the end point indicated by the color change (green-brown) of the added p-naphtol-benzein solution. ASTM D 2440, incorporated herein by reference. Test Method D2300 Procedure B, incorporated herein by reference, was performed using a gassing cell assembly and buret assembly to determine the resulting gassing tendency.

The samples were mixed with an acidified, aqueous solution of methylene blue and treated with chloroform to extract hydrophobic ion pairs. The combined chloroform extracts were washed with an acid solution to remove the less hydrophobic ion pairs (having low partition coefficients).

The intensity of the blue color remaining in the chloroform extract was measured at a wavelength of maximum absorption near 650 nm. The results are given in the following Table:

| | 72 hr. sludge | 72 hr. TAN | 164 hr. Sludge | 164 hr. TAN | Gassing Tendency |
|---|---|---|---|---|---|
| D3487 specification | 0.15 max | 0.5 max | 0.3 max | 0.6 | 30 max |
| Cycloalkane base oil | 0.01 | 0.01 | 0.01 | 0.01 | 49 |
| Cycloalkane base oil | 0.01 | 0.01 | 0.03 | 0.13 | 45 |
| Cycloalkane base oil + 0.28 wt. % BHT + 2.0 wt. % AB | <0.01 | <0.1 | 0.01 | <0.01 | −56 |
| Cycloalkane base oil + 0.075 wt. % BHT + 0.5 wt. % AB | 0.01 | 0.11 | 0.03 | 0.3 | −7 |

-continued

| | 72 hr. sludge | 72 hr. TAN | 164 hr. Sludge | 164 hr. TAN | Gassing Tendency |
|---|---|---|---|---|---|
| Cycloalkane base oil + 0.075 wt. % BHT + 0.5 wt. % DMN | 0.02 | 0.01 | 0.05 | 1.74 | 23 |
| Cycloalkane base oil + 0.075 wt. % BHT + 2.0 wt. % Biphenyl | 0.03 | <0.01 | 0.02 | 0.05 | −36 |
| Cycloalkane base oil + 0.075 wt. % BHT + 1 wt. % DMN | 0.01 | 0.01 | 0.01 | 0.01 | −5 |

With 0.28 wt. % BHT and 2.0 wt. % AB, the sample performed well exhibiting a negative gassing tendency. With 0.28 wt. % BHT and 0.5 wt. % AB, the sample performed well exhibiting a negative gassing tendency. With 0.075 BHT, the samples containing 0.5 wt. % DMN and 1.0 wt. % DMN performed well. The sample containing 2.0 wt. % AB, 0.5 wt. % AB, 1.0 wt. % DMN, and 2.0 wt. % biphenyl performed exceptionally well, exhibiting a negative gassing tendency. The 164 hour TAN result is believed to be due to experimental error.

Persons of ordinary skill in the art will recognize that many modifications may be made to the foregoing without departing from the spirit and scope thereof. The embodiment described herein is meant to be illustrative only and should be taken as limiting the invention, which is defined in following claims.

We claim:

1. A method for making a cycloalkane base oil comprising:

refining crude under refining conditions effective to produce aromatic vacuum gas oil boiling at a temperature in the range of from 371° C. to 538° C., the aromatic vacuum gas oil comprising carbonaceous materials, a majority of the carbonaceous materials being selected from the group consisting of cycloalkanes and aromatics;

contacting the aromatic vacuum gas oil with hydrocracking catalyst under hydrocracking conditions effective to produce hydrocracking product;

subjecting hydrocracking product to stripping conditions effective to increase the content of cyclic hydrocarbons selected from the group consisting of cycloalkanes, cycloalkenes, and combinations thereof and removing hydrogen sulfide and ammonia and producing stripped hydrocracking product;

contacting stripped hydrocracking product with isomerization/dewaxing/hydrogenation (IDH) catalyst comprising a metal selected from the group consisting of platinum, palladium, and combinations thereof, under IDH conditions effective to saturate aromatics to cycloalkanes, reduce normal paraffins, and to produce IDH product comprising greater than 50 wt. % of one or more cyclic hydrocarbons selected from the group consisting of cycloalkanes and cycloalkenes;

without solvent extracting, contacting IDH product with hydrotreating catalyst under hydrotreating conditions effective to produce hydrotreated product comprising greater than 50 wt. % cycloalkanes; and, separating from said hydrotreated product cycloalkane base oil comprising a quantity of less than 50 wt. % isoparaffins and 50 wt. % or more cycloalkanes, said cycloalkane base oil boiling at a temperature in the range of from about 260° C. to about 371° C.

2. The method of claim 1 comprising separating from said hydrotreated product cycloalkane base oil comprising from 50 wt. % to 70 wt. % cycloalkanes having the formula $C_nH_{2n}$ wherein n is from 15 to 30.

3. The method of claim 1 wherein the IDH conditions comprise:

IDH temperatures of from about 250° C. to about 390° C.;

IDH gas pressures greater than atmospheric;

IDH hydrogen circulation rates of from about 400 to about 15,000 SCF/B; and,

IDH liquid hourly space velocities of from about 0.1 $hr.^{-1}$ to about 20 $hr^{-1}$.

4. The method of claim 1 wherein the refining conditions are effective to produce aromatic vacuum gas oil comprising the following distribution of carbonaceous materials, in descending order of concentration: aromatics >cycloalkanes >isoparaffins >normal paraffins.

5. The method of claim 1 wherein the refining conditions are effective to produce aromatic vacuum gas oil comprising from about 40 wt. % to about 60 wt. % aromatic content.

6. The method of claim 3 wherein the refining conditions are effective to produce aromatic vacuum gas oil comprising from about 40 wt. % to about 60 wt. % aromatic content.

7. The method of claim 1 wherein the refining conditions are effective to produce aromatic vacuum gas oil comprising from about 50 to about 60 wt. % aromatic content.

8. The method of claim 1 wherein the refining conditions are effective to produce aromatic vacuum gas oil comprising from about 55 wt. % to about 60 wt. % aromatic content.

9. The method of claim 5 wherein the refining conditions are effective to produce aromatic vacuum gas oil comprising:

from about 20 wt. % to about 30 wt. % cycloalkanes;

from about 10 wt. % to about 15 wt. % isoparaffins; and, from about 5 wt. % to about 15 wt. % normal paraffins.

10. The method of claim 6 wherein the hydrocracking conditions comprise a hydrocracking pressure greater than atmospheric pressure and the stripping conditions comprise a stripping pressure greater than atmospheric pressure.

11. The method of claim 10 wherein the IDH conditions comprise an IDH pressure of greater than atmospheric.

12. The method of claim 11 wherein the IDH pressure is substantially the same as the stripping pressure.

13. The method of claim 12 wherein the hydrocracking pressure is about 30 atm or more.

14. The method of claim 6 wherein the hydrotreating conditions comprise hydrotreating catalyst effective to convert unsaturated bonds into saturated bonds comprising converting at least some of any remaining aromatics into cycloalkanes; and, hydrotreating pressure of greater than atmospheric pressure.

15. The method of claim 14 wherein the hydrotreating conditions comprise a hydrotreating pressure substantially the same as the IDH pressure.

16. The method of claim 15 wherein the hydrotreating pressure is about 30 atm or more.

17. The method of claim 1 comprising separating from said hydrotreated product cycloalkane base oil comprising from about 20 wt. % to about 40 wt. % isoparaffins.

18. The method of claim 2 comprising separating from said hydrotreated product cycloalkane base oil comprising from about 20 wt. % to about 40 wt. % isoparaffins.

19. The method of claim 1 comprising separating from said hydrotreated product cycloalkane base oil, a majority of the one or more cycloalkanes in the cycloalkane base oil comprising alkyl-substituted cycloalkanes having from about 15 to about 30 carbon atoms.

20. The method of claim 16 comprising separating from said hydrotreated product cycloalkane base oil, a majority of the one or more cycloalkanes in the cycloalkane base oil comprising alkyl-substituted cycloalkanes having from about 15 to about 30 carbon atoms.

21. The method of claim 20 comprising separating from said hydrotreated product cycloalkane base oil, 70 wt. % or more of the one or more cycloalkanes in the cycloalkane base oil comprising said alkyl-substituted cycloalkanes.

22. The method of claim 20 comprising separating from said hydrotreated product cycloalkane base oil, 90 wt. % or more of the one or more cycloalkanes in the cycloalkane base oil comprising said alkyl-substituted cycloalkanes.

23. The method of claim 1 wherein the separation conditions are fractionation conditions effective to separate hydrotreated product boiling at a temperature of greater than 371° C. as bottoms, and effective to separate hydrotreated product boiling at a temperature of less than 260° C. as overhead.

24. The method of claim 22 wherein the separation conditions are fractionation conditions effective to separate hydrotreated product boiling at a temperature of greater than 371° C. as bottoms, and effective to separate hydrotreated product boiling at a temperature of less than 260° C. as overhead.

25. The method of claim 1 further comprising adding to said cycloalkane base oil an amount of antigassing agent effective to reduce gassing tendency of the hydrotreated product.

26. The method of claim 25 wherein the amount of antigassing agent is effective to reduce gassing tendency to about +30 μL/min. or less.

27. The method of claim 25 wherein the amount of antigassing agent is effective to reduce gassing tendency to about +15 μL/min. or less.

28. The method of claim 25 wherein the amount of antigassing agent is effective to reduce gassing tendency to about +5 μL/min. or less.

29. The method of claim 25 wherein the amount of antigassing agent is effective to reduce gassing tendency to about 0 μL/min. or less.

30. The method of claim 24 further comprising adding to said cycloalkane base oil an amount of antigassing agent effective to reduce gassing tendency to about +5 μL/min. or less.

31. The method of claim 24 further comprising adding to said cycloalkane base oil an amount of antigassing agent effective to reduce gassing tendency to about 0 μL/min. or less.

32. The method of claim 1 further comprising adding to said cycloalkane base oil about 5 wt. % or less antigassing agent to produce cycloalkane-base dielectric liquid.

33. The method of claim 1 further comprising adding to said cycloalkane base oil about 2 wt. % or less antigassing agent to produce cycloalkane-base dielectric liquid.

34. The method of claim 1 further comprising adding to said cycloalkane base oil about 0.5 wt. % to about 1 wt. % antigassing agent to produce cycloalkane-base dielectric liquid.

35. The method of claim 30 further comprising adding to said cycloalkane base oil about 2 wt. % or less antigassing agent to produce cycloalkane-base dielectric liquid.

36. The method of claim 30 further comprising adding to said cycloalkane base oil about 0.5 wt. % to about 1 wt. % antigassing agent to produce cycloalkane-base dielectric liquid.

37. The method of claim 1 further comprising adding to said cycloalkane base oil a quantity of one or more antioxidant selected from the group consisting of hindered phenols, cinnamate type phenolic esters, and alkylated diphenylamines, said quantity being effective to reduce sludge formation and total acid number in mg of KOH/g (TAN) under oxidation conditions.

38. The method of claim 35 further comprising adding to said cycloalkane base oil a quantity of one or more antioxidant selected from the group consisting of hindered phenols, cinnamate type phenolic esters, and alkylated diphenylamines, said quantity being effective to reduce sludge formation and total acid number in mg of KOH/g (TAN) under oxidation conditions.

39. The method of claim 37 further comprising selecting said one or more antioxidant from the group consisting of 2,6-ditertiary-butyl para-cresol, 2,6-ditertiary butylphenol, and combinations thereof.

40. The method of claim 38 further comprising selecting said one or more antioxidant from the group consisting of 2,6-ditertiary-butyl para-cresol, 2,6-ditertiary butylphenol, and combinations thereof.

41. The method of claim 39 further comprising adding to the cycloalkane-base dielectric liquid a second quantity of one or more pour point depressants effective to reduce the pour point of the cycloalkane-base dielectric liquid to about −30° C. or less.

42. The method of claim 40 further comprising adding to the cycloalkane base oil a second quantity of one or more pour point depressants effective to reduce the pour point of the cycloalkane-base dielectric liquid to about −30° C. or less.

43. The method of claim 40 wherein said pour point depressant is effective to reduce the pour point of the cycloalkane-base dielectric liquid to about −40° C. or less.

44. A method for making a cycloalkane base dielectric liquid comprising:

processing aromatic vacuum gas oil and recovering cycloalkane base oil comprising a quantity of isoparaffins and from 50 wt. % to 70 wt. % cycloalkanes having the formula $C_nH_{2n}$ wherein n is from 15 to 30, said quantity of isoparaffins being less than 50 wt. % of said cycloalkane base oil; and, adding to said cycloalkane base oil one or more agent selected from the group consisting of an amount of antigassing agent effective to reduce gassing tendency of the cycloalkane base oil and a quantity of one or more antioxidant effective to reduce sludge formation and total acid number in mg of KOH/g (TAN) under oxidation conditions.

45. The method of claim 44 comprising adding to the cycloalkane base oil an amount of antigassing agent reducing gassing tendency of the cycloalkane base dielectric liquid to about +30 μL/min. or less, the method further comprising adding a quantity of one or more antioxidant selected from the group consisting of hindered phenols, cinnamate type phenolic esters, and alkylated diphenylamines.

46. The method of claim 44, the amount of antigassing agent reducing gassing tendency of the cycloalkane base dielectric liquid to about +15 μL/min. or less.

47. The method of claim 45, the amount of antigassing agent reducing gassing tendency to about +5 μL/min. or less.

48. The method of claim 45, the amount of antigassing agent reducing gassing tendency to about 0 μL/min. or less.

49. The method of claim 45, the amount of antigassing agent being about 2 wt. % or less based on the weight of the cycloalkane base oil.

50. The method of claim 47, the amount of antigassing agent being from about 0.5 wt. % to about 1 wt. % based on the weight of the cycloalkane base oil.

51. The method of claim 45 further comprising selecting one or more antioxidant selected from the group consisting of 2,6-ditertiary-butyl para-cresol, 2,6-ditertiary butylphenol, and combinations thereof.

52. The method of claim 50 further comprising selecting one or more antioxidant selected from the group consisting of 2,6-ditertiary-butyl para-cresol, 2,6-ditertiary butylphenol, and combinations thereof.

53. The method of claim 52 further comprising adding to the cycloalkane-base dielectric liquid a second quantity of one or more pour point depressants effective to reduce the pour point of the cycloalkane-base dielectric liquid to about −30° C. or less.

54. The method of claim 44 comprising recovering cycloalkane base oil boiling at a temperature in the range of from about 260° C. to about 371° C.

55. The method of claim 52 comprising recovering cycloalkane base oil boiling at a temperature in the range of from about 260° C. to about 371° C.

* * * * *